US005138333A

United States Patent [19]

Bartky et al.

[11] Patent Number: 5,138,333

[45] Date of Patent: Aug. 11, 1992

[54] METHOD OF OPERATING PULSED DROPLET DEPOSITION APPARATUS

[75] Inventors: W. Scott Bartky, Chicago, Ill.; Stephen Temple, Cambridge, England

[73] Assignee: Xaar Limited, United Kingdom

[21] Appl. No.: 760,804

[22] Filed: Sep. 16, 1991

Related U.S. Application Data

[63] Continuation of Ser. No. 454,809, Dec. 18, 1989, abandoned.

[30] Foreign Application Priority Data

Dec. 19, 1988 [GB] United Kingdom ..... 8829567

[51] Int. Cl.[5] ..... B41J 2/045

[52] U.S. Cl. ..... 346/1.1; 346/140 R

[58] Field of Search ..... 346/1.1, 140 R, 75; 427/421; 118/300

[56] References Cited

U.S. PATENT DOCUMENTS

| | | | |
|---|---|---|---|
| 4,104,646 | 8/1978 | Fischbeck | 346/140 R |
| 4,112,433 | 9/1978 | Vernon | 346/1.1 |
| 4,385,304 | 5/1983 | Sniderman | 346/140 R |
| 4,393,384 | 6/1983 | Kyser | 346/1.1 |
| 4,471,363 | 9/1984 | Hanaoka | 346/140 R |
| 4,491,851 | 1/1985 | Mizuno et al. | 346/1.1 |
| 4,509,059 | 4/1985 | Howkins | 346/1.1 |
| 4,646,106 | 2/1987 | Howkins | 346/1.1 |

*Primary Examiner*—George H. Miller, Jr.
*Assistant Examiner*—Victor DeVito

[57] ABSTRACT

A method of operating a pulsed droplet deposition apparatus for ejecting a liquid droplet from a nozzle supplied by a liquid retaining chamber comprises applying a first energy pulse to the liquid in the chamber of sufficient energy to effect expulsion of a droplet from the nozzle and thereafter applying a further energy pulse to the liquid in the chamber to insure that the meniscus of the body of liquid to which the droplet is attached is convex in the direction of motion of the droplet at the time of detachment of the droplet, so as to propel the droplet along the axis of the nozzle. The second pulse has an energy content which is insufficient to alone effect droplet ejection.

7 Claims, 7 Drawing Sheets

METHOD OF OPERATING PULSED DROPLET DEPOSITION APPARATUS

This application is a continuation of application Ser. No. 454,809, filed Dec. 18, 1989, now abandoned.

OBJECTS OF THE INVENTION

It is therefore a basic object of the present invention to provide an improved method for operating a droplet deposition apparatus.

It is a more specific object of the invention to provide a method of operating a pulsed droplet deposition apparatus such as a drop-on-demand ink jet printer for stabilizing droplet detachment so as to insure that the droplet direction and, if formed, the satellite droplet direction is along the nozzle axis.

These and other objects and advantages are achieved according to the present invention by operating a pulsed droplet deposition apparatus for ejecting a liquid droplet from a nozzle supplied by a liquid retaining chamber by applying a first energy pulse to the liquid in the chamber of sufficient energy to effect expulsion of a liquid droplet from the nozzle and thereafter applying further energy pulses to the liquid in the chamber which effect detachment of the droplet from the liquid expelled from the chamber at a time when the liquid has a meniscus which is convex in the sense of droplet motion, the further pulses being of insufficient energy to alone effect droplet ejection.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENTS

Figure 1:
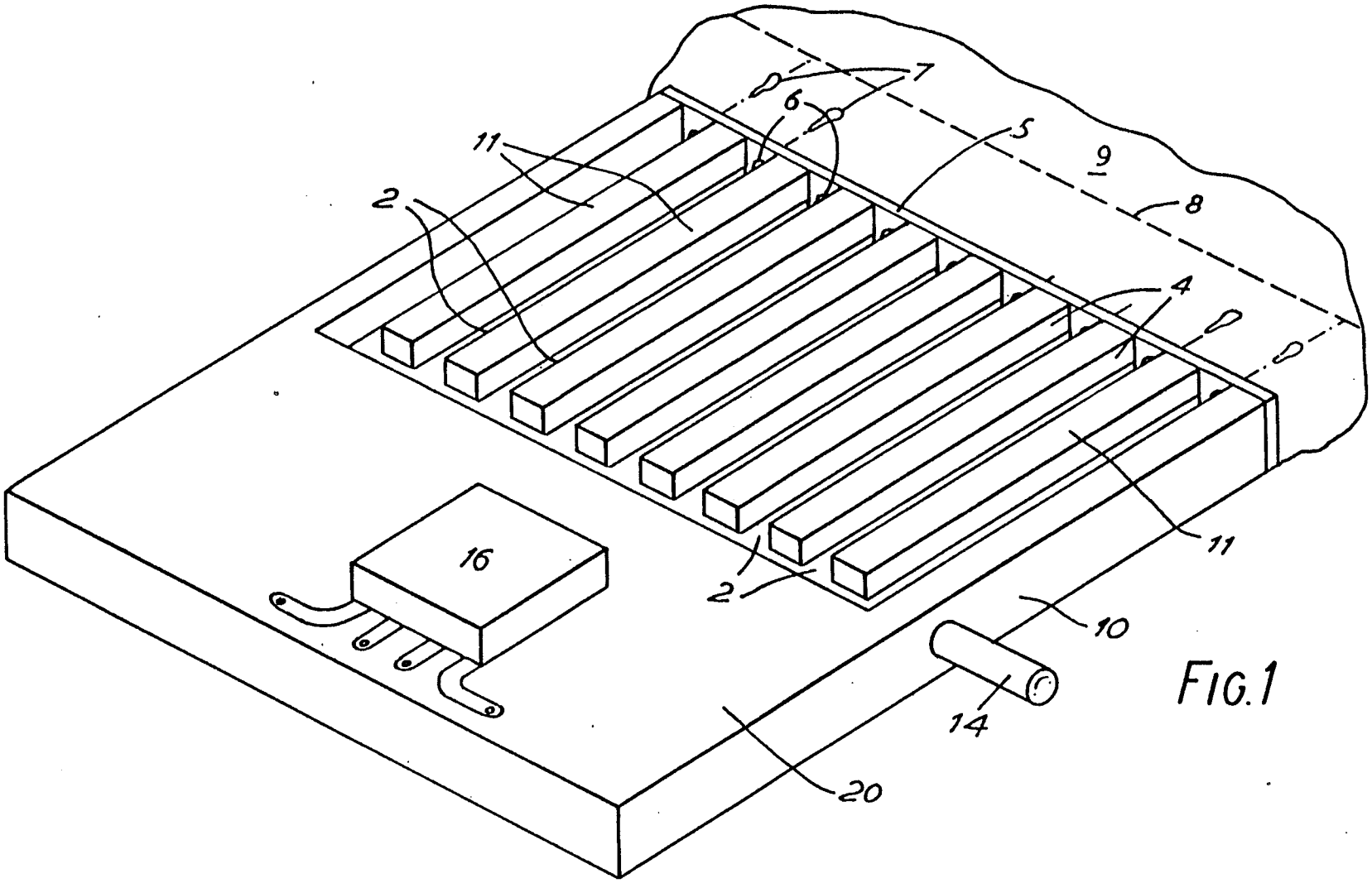
FIG. 1 is a schematic perspective view of a multichannel pulsed droplet deposition apparatus, namely, a drop-on-demand ink jet array printhead as disclosed in copending application Ser. No. 140,617; U.S. Pat. No. 4,887,100.

The process of droplet formation and separation in a droplet deposition apparatus is hereinafter described for convenience with reference to the drop-on-demand array printheads disclosed and in copending application Ser. No. 140,617, U.S. Pat. No. 4,887,100 a generalized representation of which is illustrated in FIG. 1. It will be understood, however, tat the phenomena of droplet formation and separation as described in relation thereto arises in connection with other forms of array printheads, and indeed arise generally in relation to other forms of pulsed droplet deposition apparatus, e.g. where droplet expulsion is effected by applying heat impulses to the droplet liquid.

Referring to FIG. 1, a drop-on-demand ink jet printer as disclosed in copending application Ser. No. 140,617, U.S. Pat. No. 4,887,100, comprises a printhead 10 formed with a multiplicity of parallel ink channels 2 disposed in a common plane. The ink channels 2 contain ink 4 and terminate in a nozzle plate 5 in which are formed nozzles 6, one for each channel. Ink droplets 7 are ejected on demand from the channels 2 and deposited on a print line 8 of a print surface 9. The printhead 10 has a base 20 in which the channels 2 are formed so as to extend rearwardly from nozzle plate 5. The channels 2 have opposite side walls 11 of piezoelectric material, each provided on opposite sides thereof with electrodes to which a potential difference is applied in the form of pulses to create a field normal to the side walls, to the channel axis and to the direction of poling of the piezoelectric material. Such pulses effect deflection of the side walls of each channel in opposite senses in shear mode to cause an acoustic pressure wave to travel to and fro along the length of the channels which results in droplet expulsion from the channels by way of the respective nozzles 6 communicating therewith. The channels connect at their ends remote from the nozzles with a transverse channel which in turn connects with a common ink supply (not shown) by way of a pipe 14. Electrical connections for activating the channel side walls 11 are made to an LSI chip 16 on base 20. The channels may be arranged in two groups, the channels of each group being alternately enabled to be fired to expel droplets by successive clock pulses applied to the LSI chip. Selected channels of the alternately enabled groups are fired in accordance with a multibit word supplied to the LSI chip 16. The channels may also be arranged in more than two groups of interleaved channels the groups of channels being successively enabled by successive clock pulses applied to LSI chip 16 so that selected channels of an enabled group can be simultaneously fired.

Figure 2:
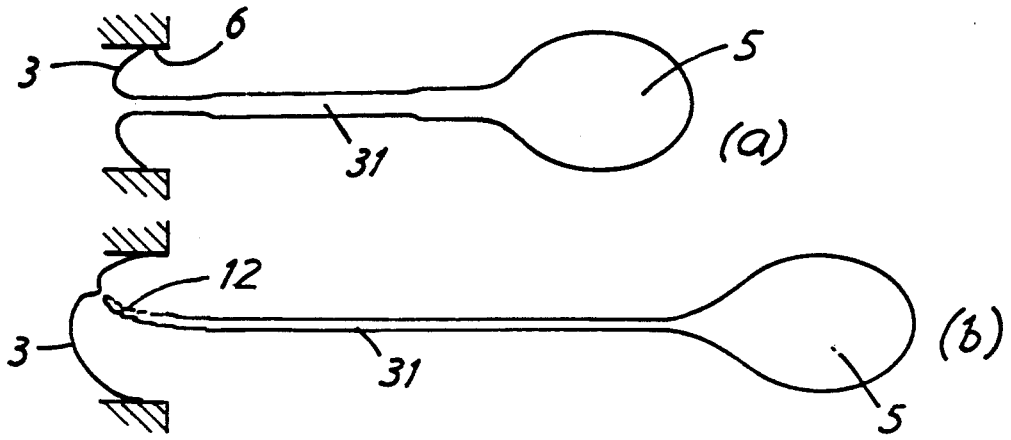
FIGS. 2A and 2B illustrate the final part of the droplet formation and detachment process in a pulsed droplet deposition apparatus, e.g. of the type shown in FIG. 1.

Referring to FIG. 2, the channels of the printhead, when fired, each expel a plug of liquid from the associated nozzle which progressively forms a droplet 25. On termination of the firing pulse, as the ink recedes into the nozzle, the plug forms a ligature 31 which connects the droplet 25 with the body of ink in nozzle 6. The receding ink in the nozzle bore has a meniscus 3 which is concave in the sense of droplet propulsion. As the ligature extends due to movement in opposite directions of the meniscus 3 and the droplet 25, the tail end 12 of ligature 31 is pulled towards the periphery of the meniscus. This movement causes ligature 31 to detach from the meniscus, or from the nozzle side wall if it has been deflected that far, with the tail end 12 at the instant of detachment being displaced from the nozzle axis. This induces an off axis velocity component at the tail end of ligature 31 which either disturbs the direction of travel of droplet 25 or generates a satellite droplet which goes off in a different direction from that of droplet 25.

Figure 4:
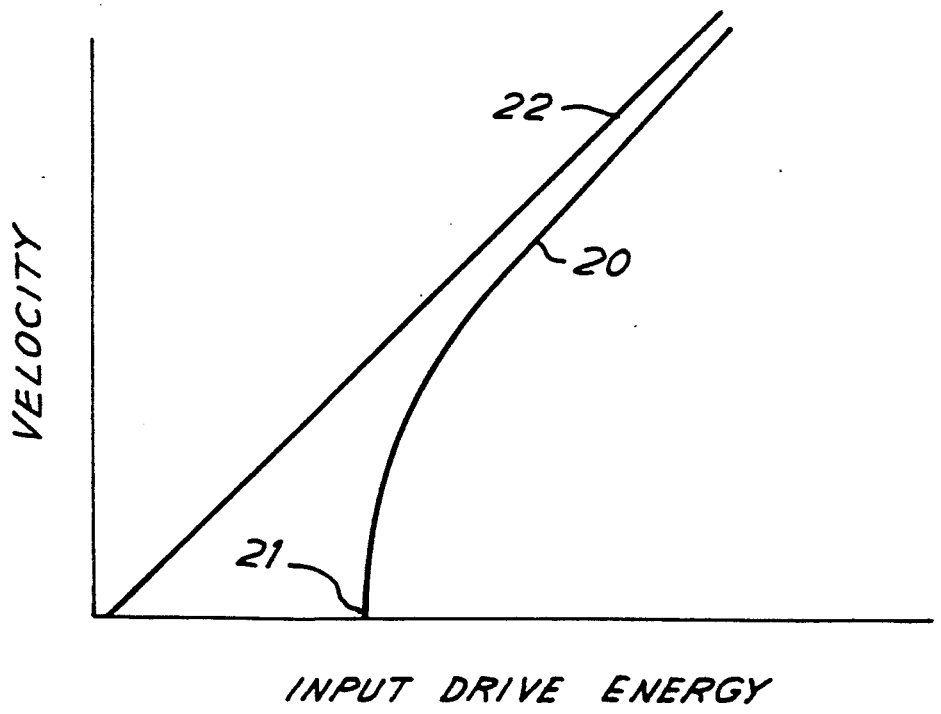
FIG. 4 illustrates the relationship between nozzle and droplet velocities and input pulse energy in a pulsed droplet deposition apparatus, e.g. shown in FIG. 1.
Figure 3:
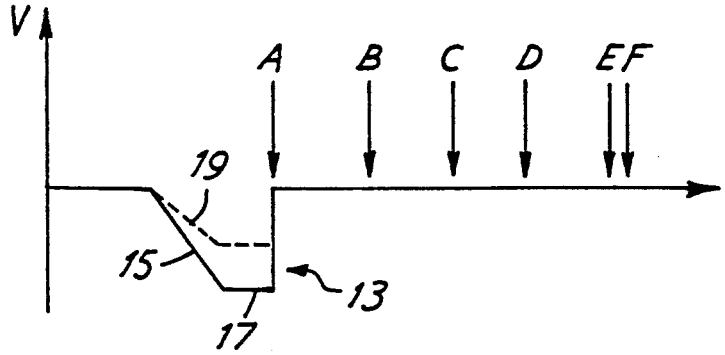
FIG. 3 shows a voltage waveform employed for firing a droplet in a pulsed droplet deposition apparatus, e.g. shown in FIG. 1.

FIG. 3 illustrates a suitable voltage waveform 13 for operating the array printhead shown in FIG. 1. As previously described, the waveform is supplied to the electrodes on opposite side walls 11 of each of the channels which are to be activated. The waveform may have a frequency of 1 to 5 KHz and a period of 10–30 microseconds. Waveform 13 initially comprises a ramp 15 falling from zero voltage. During ramp 15, the opposed walls of the channel to which the waveform is applied relax outwards to enlarge the volume of the channel. The channel consequently takes in additional ink from the common ink supply to the channels of the array. The rate of fall of ramp voltage 15 is less than that required to expel a droplet from the immediately adjacent channels. After the maximum negative voltage of the ramp 15 is reached, the voltage remains constant over the remaining part 17 of the period of the waveform, at the end of which the voltage level rapidly returns to zero. During the constant voltage part 17 of the waveform, ink is taken into the channel. When the voltage is returned to zero volts, the channel walls move sharply towards one another to impart an energy pulse to the ink in the channel which effects droplet projection therefrom by causing an acoustic pressure wave to travel along the length of the channel. The acoustic wave continues, until damped out, to travel up and down the channel after droplet expulsion therefrom and during ink replenishment therein and causes oscillation of the meniscus in the nozzle bore. It will be apparent that during the fall of the waveform voltage along ramp 15, the channel is being "armed" for droplet expulsion. Such expulsion occurs when the channel is "fired" by rapidly returning to zero volts at the end of the period of the waveform. The broken line 19 in FIG. 3 shows the threshold above which the waveform ramp voltage is insufficient to cause droplet expulsion from the channel. FIG. 4 similarly shows graphically that for input energy pulses of a value less than that indicated by a point 21, no droplet is emitted, the droplet and nozzle liquid velocities being shown by the characteristics 26 and 28, respectively.

Figure 5:
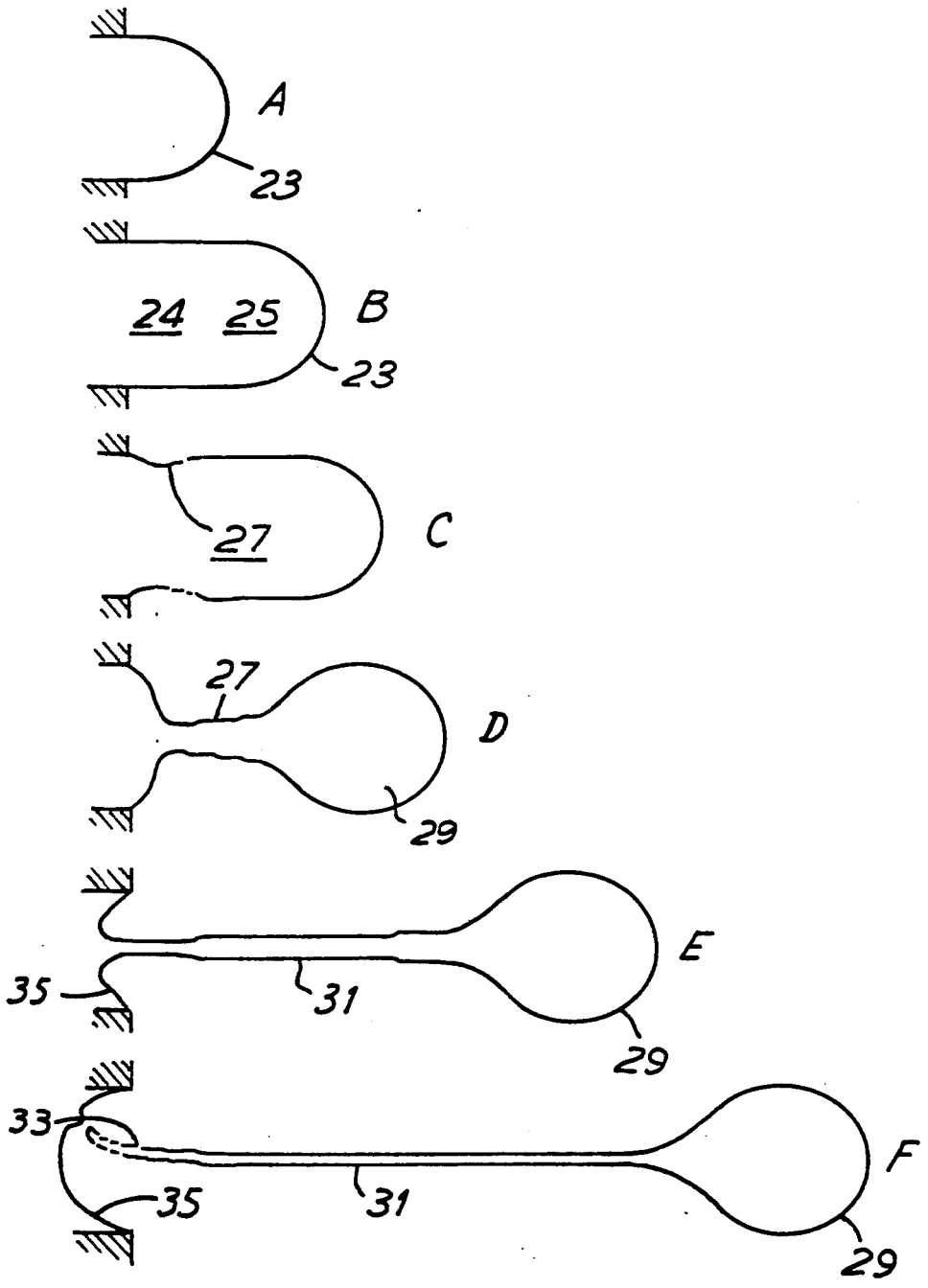
FIG. 5 shows a typical droplet evolution generated by the waveform of FIG. 3.

FIG. 5 illustrates in detail the development of a droplet expelled from a channel following firing of a channel by the waveform of FIG. 3. As indicated at time A after firing, ink has emerged from the outlet orifice of nozzle 6 and has formed a meniscus 23 which is convex in the sense of motion of the ink. Slightly later at time B, a cylindrical plug 24 of ink having the convex meniscus 23 at its forward end has formed. A neck 27 next begins to form at time C and by time D, the neck has narrowed so defining a droplet 29 from the forward part of the plug 24. Between times D and E, the acoustic wave in the channel reverses so that by time E a ligature 31 has formed. The body of ink to which the tail end 33 of ligature 31 is connected has drawn back into the nozzle and, in so doing, the meniscus 36 thereof has reversed to become concave in the direction of droplet motion. Later at time F, the tail end 13 of ligature 31 has detached from the ink in the nozzle bore, but prior to doing so, has moved along the curve of the meniscus from the center thereof. As previously intimated, detached ligature 31 then either causes deflection of droplet 29 from its motion along the nozzle axis or breaks off from the droplet to form a satellite droplet which is smaller than the droplet 29.

Figure 6:
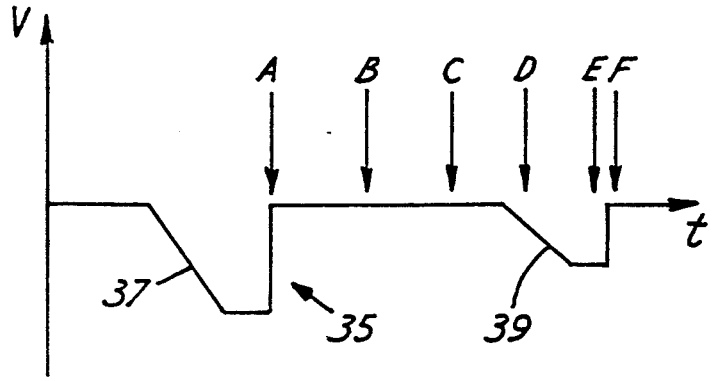
FIG. 6 shows a voltage waveform employed in a method of operating a pulsed droplet deposition apparatus according to the present invention.

Turning to FIG. 6, a voltage waveform 35 is illustrated which is employed in accordance with the present invention to insure that droplet 29 or, if formed, a satellite thereof, is propelled along and not deflected from the nozzle axis. Waveform 35 has a first occurring part 37 corresponding to waveform 13 of FIG. 3 and a second occurring part 39. Part 39 has the same general form as part 37 but is of smaller amplitude so that it gives rise to an energy pulse in the ink channel whose energy content is less than value 21 (see FIG. 4) and which is of insufficient magnitude to cause droplet expulsion from the channel.

Figure 7:
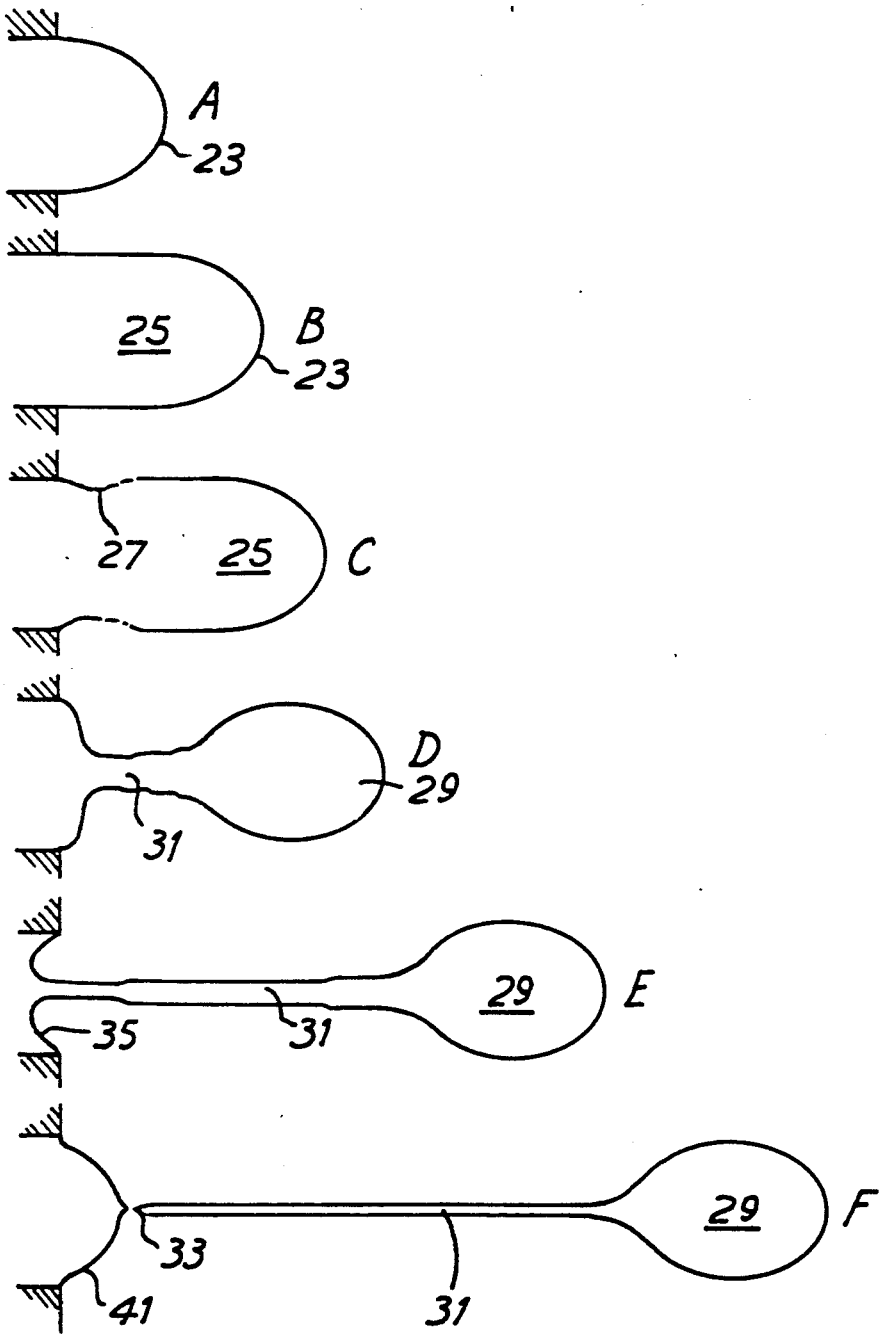
FIG. 7 shows a typical droplet evolution generated by the waveform of FIG. 6.

Referring to FIG. 7, following the application of part 37 of waveform 35 to the channel side walls, the ink droplet formation generally follows stages A to E as described for the waveform of FIG. 3. However, it will be observed that in this case the channel is being rearmed by waveform part 39 from time C through time E. Thereafter, the rearming voltage is held constant until a time slightly prior to time F, at which time the channel is again fired so that at time F the concave meniscus 35 present at time E has reversed to form a convex meniscus 41 as the energy pulse attributable to waveform part 39 reverses the flow of ink in nozzle 6. The effect of this reversal of the meniscus is to cause the tail end 33 of ligature 31 to be disposed at the center of the meniscus 41 which lies on the nozzle axis at the time of detachment of the ligature from the body of ink in the nozzle. The development of an off axis velocity component at the tail end of the ligature is thus prevented and the droplet 29 and any satellite droplets thereof, if formed, are projected along the nozzle axis.

It has been found that at drives below the droplet emission threshold quite substantial ink plugs, e.g. plug 25 of FIGS. 5 and 7 are generated. At the droplet emission threshold, the droplet size was measured as 70% to 80% of the volume of a three meter per second ejected droplet required for printing. If the drive pulse energy is lowered further, it is found that only a very small energy pulse is needed to effect the desired reversal of the meniscus.

The actual time of detachment of ligature 31 is more a function of the nozzle and liquid parameters than characteristics of the actuator's acoustic length. Observations in the laboratory have shown the detachment time as being relatively independent of the driving waveform or its total energy. At low drive energies, the drop velocity is lower and the ligature is shorter, but the detachment occurs at the same time. Droplet detachment time is, however, affected by liquid viscosity so that if the apparatus were working in an environment where temperature changed substantially, it would be necessary to change the timing of voltage waveform part 39 to control the droplet detachment in dependence upon viscosity variation.

Although the embodiment of the invention described with reference to FIGS. 6 and 7 employs a voltage waveform of the "arm and fire" form, it is also possible to use a "fire and arm" type of waveform. That is, a waveform can be used in which both the main droplet projecting pulse and the supplementary meniscus reversing pulse commence with an instantaneous fall of voltage which is followed by a constant voltage period and a slow rise of voltage. This effects rapid movement of the channel walls to impart energy to the ink followed by holding the walls at their inward deflected positions and then effecting slow restoration of the walls to their starting positions.

Figure 8:
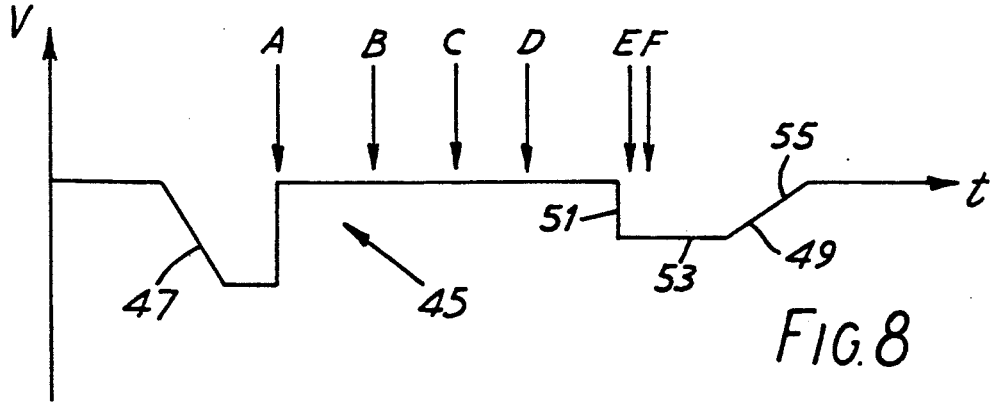
FIG. 8 shows an alternate voltage waveform to that of FIG. 6 which may be used to perform the method of the invention.
Figure 9:
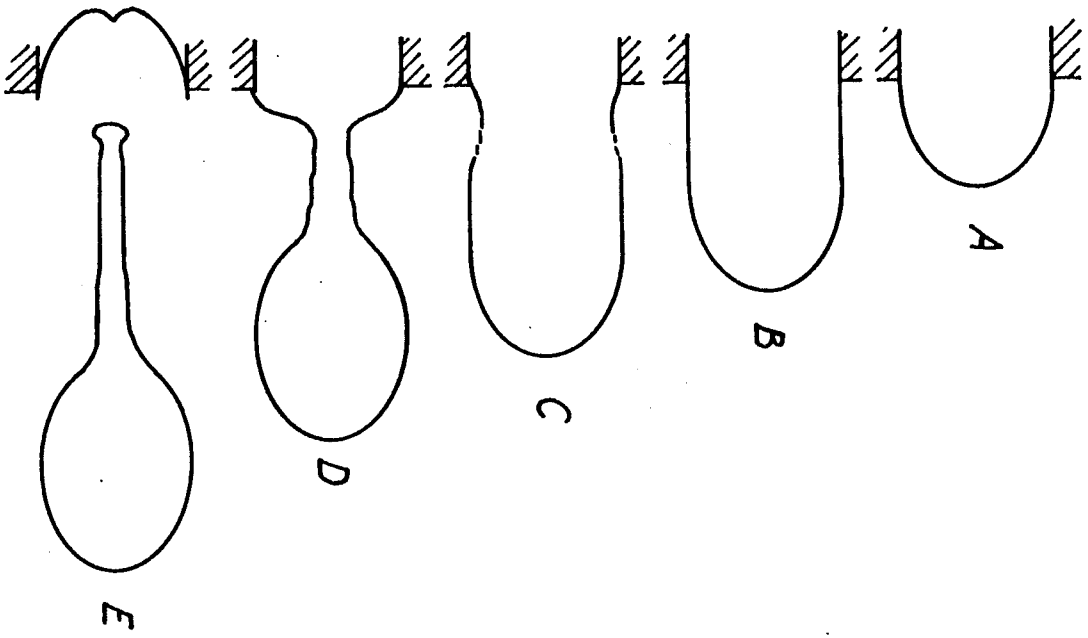
FIG. 9 shows a typical droplet evolution generated by the waveform of FIG. 8.

Referring now to FIG. 8 and 9, an embodiment of the invention inducing an early detachment of droplet 29 is illustrated. A waveform 45 (FIG. 8) includes a first part 47 which corresponds to waveform part 37 of FIG. 6 and gives rise to droplet formation conditions at times A to D as before. Part 49 of waveform 45, which imparts a further pulse of energy to the ink, is initiated between times D and E by an instantaneous voltage drop 51. Voltage drop 51 causes a rapid reduction of the ink pressure in the channel forcing the liquid meniscus to be reversed from its convex configuration at time D to a concave configuration at time E. Ligature 31 is therefore broken before the tail end 33 thereof has moved along the meniscus toward the nozzle side wall and while the meniscus is still in its convex sense. Since ligature 31 has very small volume, there is no significant loss of droplet volume. The pressure in the channel is held reduced by keeping the voltage constant for an interval of time 53 and is then gradually restored over a time interval when voltage 55 rises to zero.

In the embodiment of the invention described with reference to FIGS. 8 and 9, although waveform part 47 has an "arm and fire" part for droplet expulsion, the waveform part could alternately be of the "fire and arm" form described as the alternative form used in the embodiment of FIGS. 6 and 7. However, the supplementary, meniscus reversing pulse necessarily must be of the kind where the leading edge thereof effects rapid lowering of the ink pressure in the channel so that rapid severance of the droplet ligature from the body of ink in the nozzle is effected before the meniscus assumes a concave form.

This method of forcing early droplet severance has the advantage of completing the drop formation time sooner than is the case with waveform 35 thus allowing higher speed operation and more time for further correction of the resonant waves travelling in the adjacent channels. Another advantage is that if the ligature is short, the likelihood of satellite generation is lowered and a higher drop velocity can be achieved.

As will now be apparent, in the waveform employed in the embodiment of the invention described with reference to FIGS. 6 and 7, the secondary pulse 39 imparts further energy to the liquid in the actuated channel to insure that the meniscus of the body of liquid to which the droplet is attached is convex in the direction of droplet propulsion and forward of the nozzle at the instant of droplet detachment (which occurs after a constant interval following the termination of pulse 37). However, in the embodiment of the invention described with reference to FIGS. 8 and 9, the secondary pulse 49 is applied at a time when the body of liquid to which the forming droplet is attached is outside the nozzle so that the meniscus formed on that body of liquid is convex and the effect of the pulse 49 is to cause droplet separation at a time earlier than would be the case were the waveform of FIG. 6 employed. Thus the waveforms of the secondary pulses 39 and 49 serve different purposes, pulse 39 insuring that the meniscus of the body of liquid to which the droplet is attached is convex in the direction of droplet propulsion and the pulse 49 effecting, at a time when the meniscus is convex, earlier droplet separation at a time before the body of liquid has been drawn back into the nozzle.

In view of the foregoing, it will be understood that two secondary pulses following pulse 37 or 47 can be employed instead of a single secondary pulse. The first secondary pulse is applied when the body of liquid to which the droplet is attached has been drawn back into the nozzle to reverse the meniscus from concave to convex form. The second secondary pulse is then applied to reverse the motion of the body of liquid projecting from the nozzle relative to that of the droplet being formed to effect early separation of the droplet.

Figure 10:
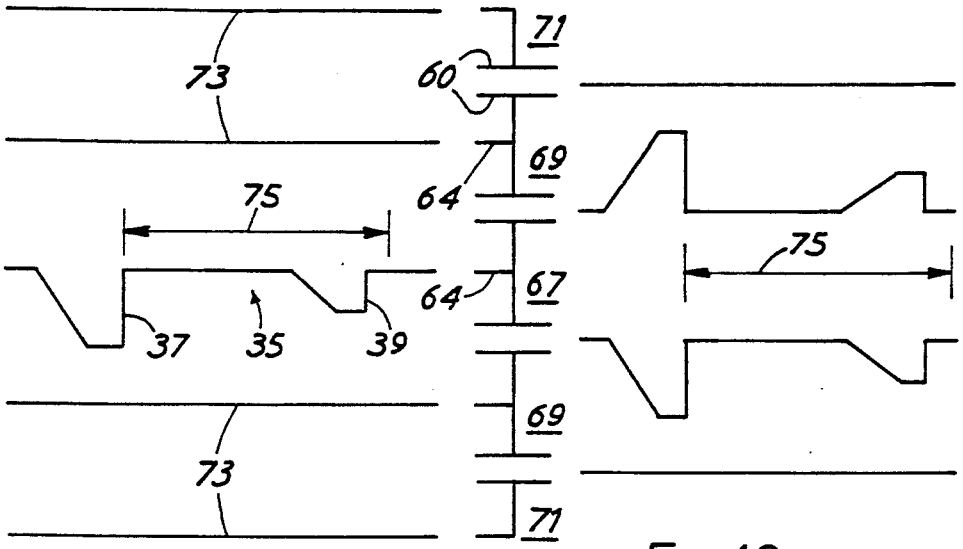
FIG. 10 is a diagram illustrating the operation of an array-type, drop-on-demand printer employing the voltage waveform of FIG. 6.

FIG. 10 diagrammatically illustrates the operation of a drop-on-demand array printhead of the type shown in FIG. 1 in response to the voltage waveform of FIG. 6. The electrode linings of the ink channels of the array are represented by electrodes 60 formed on facing surfaces of the channel dividing side walls. The electrode lining of each channel has attached thereto an electrical connection 64 which connects with the LSI driver chip. As described previously, the side walls of the channels each deflect in shear mode when the electrodes on opposite sides thereof are subjected to a potential difference. Such a potential difference is applied in opposite senses to the side walls of an actuated channel by holding the potential of the electrode linings of the channels on opposite sides of the actuated channel at ground potential while a positive or negative potential is applied to the electrode lining of the actuated channel. In this way the facing side walls of an actuated channel are deflected in shear mode in opposite senses.

As also previously described, the channels are preferably divided into two groups respectively of odd and even numbered channels, the channels of the two groups being alternately enabled by successive clock pulses applied to the LSI chip to which the connections 64 are attached. As each group of channels is enabled, channels of the enabled group are selected for actuation by a multi-bit word applied by the LSI chip to each of the selected channels.

In FIG. 10, waveform 35 (see FIG. 6) is shown being applied to a selected odd numbered channel 67. The even numbered channels 69 on respective opposite sides of the selected odd numbered channel 67 are not actuated since only odd numbered channels are enabled. Also, for the purpose of this description, it is assumed that the odd numbered channels 71 on the sides of the illustrated even numbered channels 69 remote from channel 67 are also not selected for actuation. Accordingly, the line voltages 73 applied to the connections 64 of the illustrated unselected even and odd numbered channels 69 and 71 are held to ground during the application of waveform 35 to the selected odd numbered channel 67. At the righthand side of the drawing, the deflection of the channel side walls is shown as waveform 35 is applied. Thus, the facing side walls of selected channel 67 are seen for both droplet ejection pulse 37 and secondary pulse 39, first to deflect outwards, the to dwell in the outwardly deflected position and thereafter to be brought instantaneously back to the initial position thereof. Droplet formation is initiated by termination of pulse 37 and droplet detachment occurs after time 75, i.e. shortly following termination of pulse 39 when the body of liquid projects from the channel nozzle and thus has a meniscus which is convex in the direction of droplet propulsion. The time 75 taken for droplet detachment is substantially constant and the secondary pulse is applied prior to droplet detachment.

Figure 11:
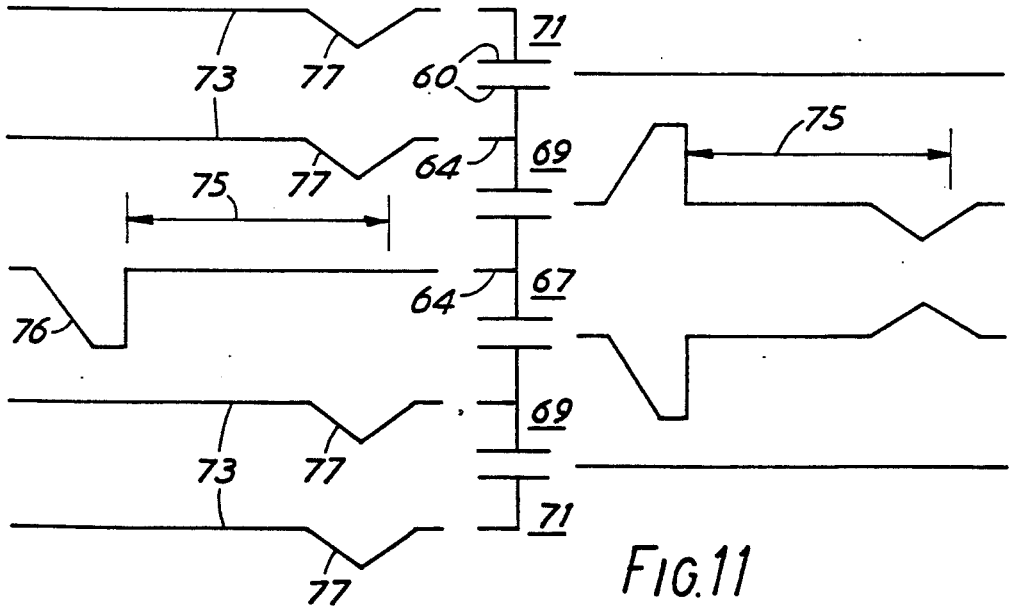
FIG. 11 is a diagram similar to that of FIG. 10 which illustrates a further embodiment of the invention.

An arrangement which has been found to be easier to implement consistently is shown in FIG. 11. In this embodiment, secondary energy pulses do not deflect the channel side walls of selected channel 67 in the same sense as they are deflected by the primary pulse as shown in FIG. 10, but rather deflect them in the opposite sense. For reasons of economy it is desirable to employ a unipolar LSI chip in the channel drive circuits and with such a chip it is not possible to apply primary and secondary pulses of opposite polarity to the selected channel side walls. However, as shown in FIG. 11, the desired effect of imparting energy to the liquid in the actuated channel by moving the side walls initially inwardly rather than outwardly can be achieved by applying secondary pulses 77 of the same polarity as the primary pulse 76 to each wall of the non-selected odd numbered channels, such as channels 71, and all the even numbered channels, such as channels 69. It will be seen that when pulses 77 are so applied, the electrode of selected channel 67 is at ground potential while the electrodes of the adjacent even numbered channels 69 are subject to the pulses 77. The side walls of the selected channel are therefore deflected in shear mode inwardly, as indicated on the righthand side of the drawing, applying a secondary energy pulse to the liquid in the channel. The behavior is therefore as if a secondary voltage pulse was applied to the selected odd numbered channel 67 of opposite polarity to the first voltage pulse 76.

It will be noted that the secondary correction pulses 77 applied to all the non-actuated channels are of different form than pulse 39 (the secondary pulse in FIG. 6), having symmetrical leading and trailing ramps 81, 83 which results in a rounder meniscus profile. The correction pulse further is applied to both sides of the opposite side walls of all of the unactuated channels so that no field is applied to those side walls and no deflection thereof occurs and no meniscus motion is therefore generated in those channels.

It will be understood that numerous changes and modifications in the described embodiments of the invention may be made without departure from the true spirit and scope of the invention. For example, the invention can also be applied to apparatus such as disclosed in U.S. Pat. No. 4,296,621 in which drop projection is effected by a heating pulse applied to the ink channel, suitably, near the nozzle end thereof. In this patent, the droplet propulsion pulse is desirably of rectangular form. Likewise the supplementary pulse for effecting meniscus disposition in convex form in the sense of liquid motion, whether effected early or late in the process of droplet formation should also be of rectangular form and, of course, of energy content below the threshold at which droplet propulsion occurs. The invention therefore is to be limited only as defined in the claims.

What is claimed is:

1. The method of operating an apparatus comprising an array of parallel liquid containing channels, a plurality of nozzles respectively communicating with said channels, electrically actuatable means for applying energy pulses to the liquid in selected ones of said channels to effect expulsion of drops of said liquid therefrom, and liquid supply means for replenishing the liquid expelled from said channels by operation of said electrically actuatable means, said method comprising operating said electrically actuatable means to apply first energy pulses to the liquid in said selected channels to expel liquid from the nozzles respectively communicating therewith and to initiate formation of a drop in the liquid expelled from the nozzle communicating with each of said selected channels and further operating said electrically actuatable means to apply a second energy pulse to the liquid in each of said selected channels following said first energy pulse applied thereto to cause the liquid in which said drop formation is taking place to have a meniscus to which said drop being formed is attached which is convex in the direction in which said drop being formed is moving and is moving in a direction reverse to that in which said drop being formed is moving thereby to effect detachment of said drop, each of said second pulses being of lower energy content than said first energy pulses and of insufficient energy content itself to cause ejection of a drop of liquid from the corresponding nozzle, the energy content of each of said first energy pulses being sufficient to cause ejection of a drop of liquid from the corresponding nozzle.

2. The method of operating an apparatus comprising an array of parallel liquid containing channels, a plurality of nozzles respectively communicating with said channels, electrically actuatable means for applying energy pulses to the liquid in selected ones of said channels to effect expulsion of drops of said liquid therefrom, and liquid supply means for replenishing the liquid expelled from said channels by operation of said electrically actuatable means, said method comprising operating said electrically actuatable means to apply first energy pulses to the liquid in said selected channels to expel liquid from the nozzles respectively communicating therewith and to initiate formation of a drop in the liquid expelled from the nozzle communicating with each of said selected channels and further operating said electrically actuatable means to apply a second energy pulse to the liquid in each of said selected channels following said first energy pulse applied thereto to cause the liquid in which said drop formation is taking place to have a meniscus to which said drop being formed is attached which is convex in a direction in which said drop being formed is moving, and then operating said electrically actuatable means to apply a third energy pulse to the liquid in each of said selected channels to cause said meniscus to move in a direction reverse to movement of said drop attached thereto thereby to effect detachment of said drop, each of said second and third energy pulses being of insufficient energy content to cause ejection of a drop of liquid from the corresponding nozzle.

3. The method of operating an apparatus comprising an array of parallel liquid containing channels forming an array direction, each of said channels having a longitudinal axis, channel dividing side walls respectively separating successive channels of said array of channels, said side walls being formed with piezoelectric material poled in a direction normal both to said array direction and said channel axes and each having channel facing surfaces on opposite sides thereof, an electrode respectively provided on each of said channel facing surfaces, a plurality of nozzles respectively communicating with said channels, and electrically actuatable means for applying voltage pulses to the electrodes of the side walls of selected ones of said channels to deflect said side walls in shear mode thereby to impart energy pulses to the liquid in said selected channels to expel respective drops of said liquid from the nozzles of said channels, said method comprising operating said electrically actuatable means to apply first energy pulses to the liquid in said selected channels to expel liquid from the nozzles respectively communicating therewith and to initiate formation of a drop in the liquid expelled from the nozzle communicating with each of said selected channels and further operating said electrically actuatable means to apply a second energy pulse to the liquid in each of said selected channels following said first energy pulse applied thereto to cause the liquid in which said drop formation is taking place to have a meniscus to which said drop being formed is attached which is convex is a direction in which said drop being formed is moving and is moving in a direction reverse to that in which said drop being formed is moving thereby to effect detachment of said drop, each of said second pulses being of lower energy content than said first energy pulses and of insufficient energy content itself to cause ejection of a drop of liquid from the corresponding nozzle.

4. The method of claim 3 wherein each of said second pulses is applied to the corresponding one of said selected channels when the liquid expelled from said corresponding channel, in which formation of a drop was initiated by a corresponding one of said first pulses, is outside the nozzle of said corresponding channel, said second pulses being adapted to effect rapid motion of said expelled liquid towards said corresponding channel thereby to cause rapid detachment of said drop being formed from said expelled liquid.

5. The method of claim 3 wherein said electrically actuatable means is operated for applying successive voltage pulses to the electrodes of the channel side walls of each of said selected channels thereby to impart said first and second energy pulses to said liquid in each of said selected channels.

6. The method of claim 3 wherein said electrically actuatable means is operated for applying a first voltage pulse to the electrodes of the channel side walls of each of said selected channels thereby to impart said first energy pulses to the liquid in said selected channels and is subsequently operated for applying a second voltage pulse of a same polarity as said first voltage pulse to the electrodes of the channel side walls of each of said channels other than said selected channels thereby to impart said second energy pulses to said selected channels.

7. The method of claim 6 wherein said second voltage pulse includes symmetrical leading and trailing ramps.

* * * * *